US006065271A

United States Patent [19]

Nicastro

[11] Patent Number: 6,065,271

[45] Date of Patent: May 23, 2000

[54] BAG FILLING AND SEALING APPARATUS

[76] Inventor: Salvatore Nicastro, 3250 Delauney, Laval, Quebec, Canada, H7L 5E1

[21] Appl. No.: 09/071,836

[22] Filed: May 4, 1998

[30] Foreign Application Priority Data

May 2, 1997 [CA] Canada ..... 2204309

[51] Int. Cl.[7] ..... B65B 43/26; B65B 7/06

[52] U.S. Cl. ..... 53/570; 53/284.7; 53/373.6; 53/374.9

[58] Field of Search ..... 53/373.6, 374.9, 53/570, 284.7, 268

[56] References Cited

U.S. PATENT DOCUMENTS

| | | | |
|---|---|---|---|
| 2,732,988 | 1/1956 | Feinstein | 53/373.6 |
| 3,055,154 | 9/1962 | Markley | 53/551 |
| 3,241,290 | 3/1966 | Ingleson | 53/373.6 |
| 4,071,999 | 2/1978 | Nolet . | |
| 4,078,358 | 3/1978 | Henderson | 53/373.6 |
| 4,378,266 | 3/1983 | Gerken . | |
| 4,574,560 | 3/1986 | Tetenborg et al. . | |
| 4,688,371 | 8/1987 | Hecht | 53/570 |
| 4,704,845 | 11/1987 | Bruno | 53/373.6 |
| 5,165,455 | 11/1992 | De Crane | 53/570 |

FOREIGN PATENT DOCUMENTS

| | | | |
|---|---|---|---|
| 565145 | 3/1993 | Japan | 53/373.6 |
| 6191519 | 7/1994 | Japan | 53/373.6 |

*Primary Examiner*—John Sipos

*Attorney, Agent, or Firm*—Watson Cole Grindle Watson, PLLC

[57] ABSTRACT

A machine for automatically filling and sealing large bulk thermoplastic bags which includes: a framework with a base and a backplane having an integral sliding carriage; a pneumatically controlled filling spout which holds the bag open for filling; a pneumatically controlled finger mechanism which aligns the bag for sealing; and a pneumatically controlled sealing mechanism which comprises a mounting arm, a guide rail, a first and second pneumatic cylinder and a heat sealing assembly. The heat sealing assembly uses electrically heated pads and pressure to seal the upwardly open end of a thermoplastic bag after it has been filled.

3 Claims, 5 Drawing Sheets

BAG FILLING AND SEALING APPARATUS

BACKGROUND TO THE INVENTION

This invention relates to an apparatus for automatically filling and sealing thermoplastic bags using heat sealing means. In particular, it relates to an apparatus for filling and sealing large bulk thermoplastic bags which when filled can weigh several hundred kilograms.

Many examples of bag sealers which employ heat are known. U.S. Pat. No. 4,378,266, for example, discloses a relatively small manual device for use in the home which comprises stationary and compression elements pivotally connected. The stationary element provides a heated surface which fuses the open ends of a plastic bag when the compression element is rotated against the stationary element. This device seals adequately but is unsuitable for larger industrial applications where large bulk bags are involved. Further, it does not provide automatic bag filling means.

Several patents are directed to bag sealers for use in an industrial environment. In U.S. Pat. No. 4,574,560, grippers are used to hold the end of a sack in a vertical position and stretch it along its width. Pressure bars hold the sack end below the grippers while heated welding and backing bars seal the sack end after adhesive has been discharged onto the sack end. This device also seals satisfactorily but it too does not incorporate automatic bag filling means and the use of adhesive unnecessarily complicates the device.

U.S. Pat. No. 4,071,999 discloses a bag sealer employing heat sealing means. In this device, a carriage inserts hydraulically controlled hook-shaped fingers which pull the mouth of a filled bag taut while opposing pusher fingers push inwardly to form folds. A heat sealer comprising a two part clamp than clamps the opening of the taut bag and seals the contents therein. Once again a heat sealer is described which has no adequate bag filling means.

In short, while all of the patents discussed above function adequately as bag sealers, none of them include automatic bag filling means which cooperate with the bag sealing equipment.

SUMMARY OF THE INVENTION

This invention seeks to provide an apparatus which combines the bag filling function with the bag sealing function in one automated apparatus.

This invention provides an apparatus for filling and sealing thermoplastic bags comprising:

- a framework;
- bag locating means for positioning successive separate bags;
- bag aligning means to facilitate heat sealing operations wherein the bag aligning means moves from a first position to receive the open bag end, and to a second position to stretch and align the bag for sealing;
- bag supporting means;
- bag opening and filling means; and
- bag sealing means adapted to heat seal the upwardly extending open end of a thermoplastic bag.

Conveniently, the framework includes a platform scale and a vertically extending backplane including a support frame and a pneumatically controlled carriage. Conveniently, an electronic platform scale is used.

More conveniently, the bag locating means includes a vibrating platform integrally mounted above the platform scale of the framework.

Preferably, the bag opening and filling means includes an upper and lower portion connected by a flexible sleeve wherein the upper portion is mounted to the support frame and the lower portion is mounted on the carriage and terminates in a dust-tight filling spout in the form of an inflatable sleeve.

More preferably, the bag aligning means includes at least two pneumatically controlled finger rods extending perpendicularly from the carriage on opposite sides of the dust-tight filling spout. Conveniently, the bag support means includes at least two forks extending perpendicularly from the carriage on opposite sides of the dust-tight filling spout which can be laterally adjusted.

Preferably, the bag sealing means extends from the carriage of the framework in a horizontally planar and transverse relationship with the fingers of the bag aligning means. The sealing means includes a mounting arm, guide rail, first and second pneumatic cylinders and a heat sealer assembly wherein the heat sealer assembly is moved along the guide rail by the first pneumatic cylinder and includes opposing sets of interlocking and folding arms, each of which terminate in a heat sealer. At least one of the interlocking arms from each set is rotationally connected to the heat sealer assembly so that the sets of interlocking arms can be moved from a retracted position to an extended position by the second pneumatic cylinder.

The present invention is advantageous in that it allows for the automated filling and sealing of bags at one station, thereby eliminating the need for a multiple station production line. As well, allowing multiple operations to occur at a single station, minimizes manual operator handling of each bag which increases the speed and overall efficiency of the bag filling and sealing operation and reduces the risks of bag puncture, spillage and contamination inevitable in a manual handling operation where heavy bags are involved.

BRIEF DESCRIPTION OF THE DRAWINGS

Other purposes and advantages of the invention will become apparent as it is now described in detail with reference to the appended drawings, wherein.

DESCRIPTION OF THE PREFERRED EMBODIMENT

Figure 1:
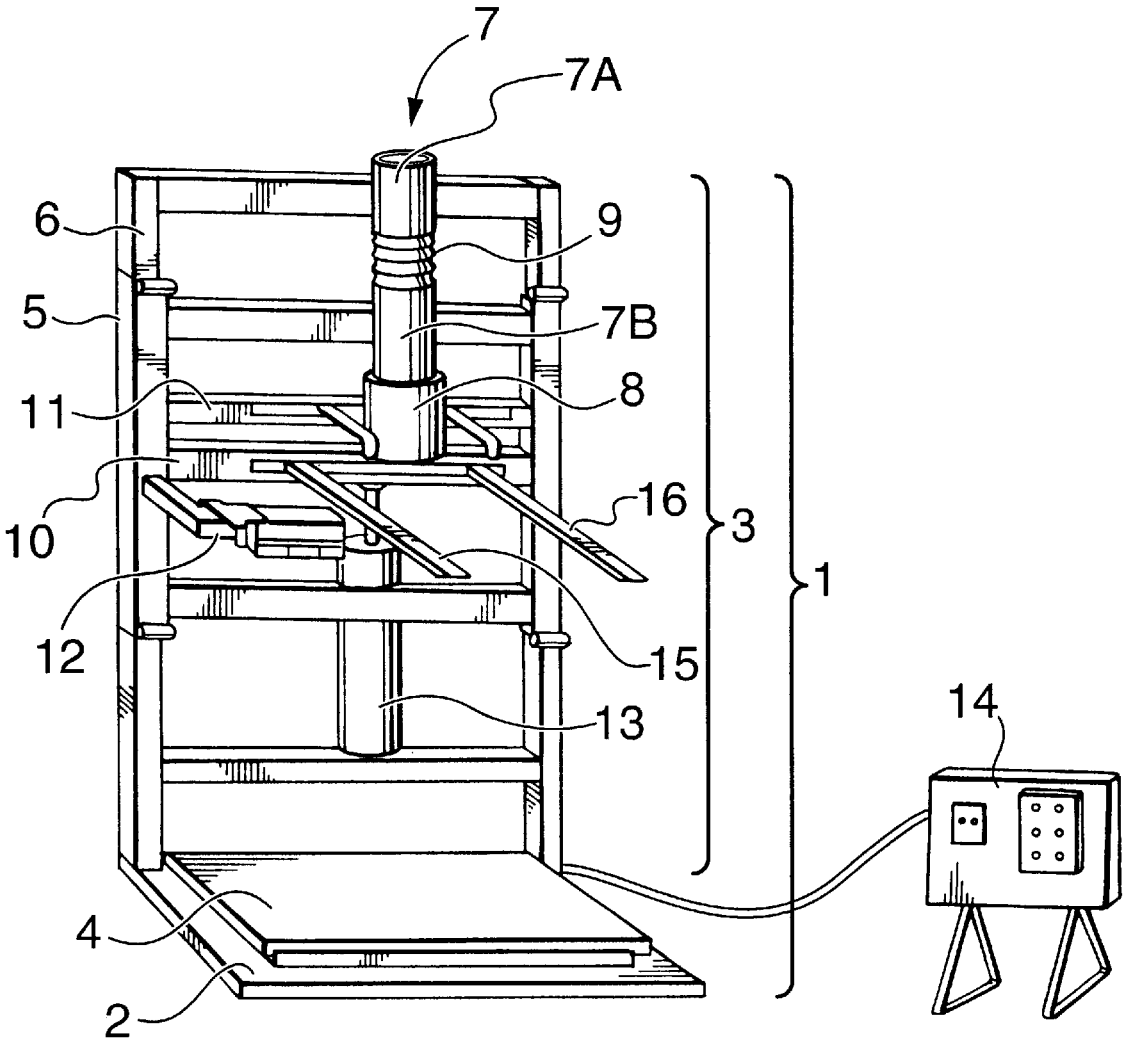
FIG. 1 is a perspective drawing of the preferred embodiment.

Referring to FIG. 1, a preferred embodiment of the invention is depicted. Framework 1 includes an electronic platform scale 2 and a backplane 3. Mounted on electronic platform scale 2 is vibrating platform 4. Backplane 3 includes carriage 5 which is slidably received onto support frame 6. Spout 7 has an upper portion 7A, a lower portion 7B which terminates with an inflatable sleeve 8, and flexible sleeve 9. Lower portion 7B connected to inflatable sleeve 8 moves vertically from a retracted position to an extended position by way of a pneumatic cylinder (not shown). Integral to carriage 5 is fork assembly 10 with laterally adjustable forks 15, 16, finger mechanism 11 and sealing mechanism 12. Pneumatic cylinder 13 controls the movement of carriage 5 along support frame 6. Vibrating platform 4, finger mechanism 11, pneumatic cylinder 13, sealing mechanism 12 and the pneumatic cylinder controlling spout 7 (not shown) are all regulated through control panel 14. It will be understood by those skilled in the art that vibrating platform 4 may be replaced by a conveyor belt or roller system and that sealing mechanism 12 may be conveniently mounted to framework 1 at a variety of locations. These other embodiments are also considered part of the present invention.

Figure 2:
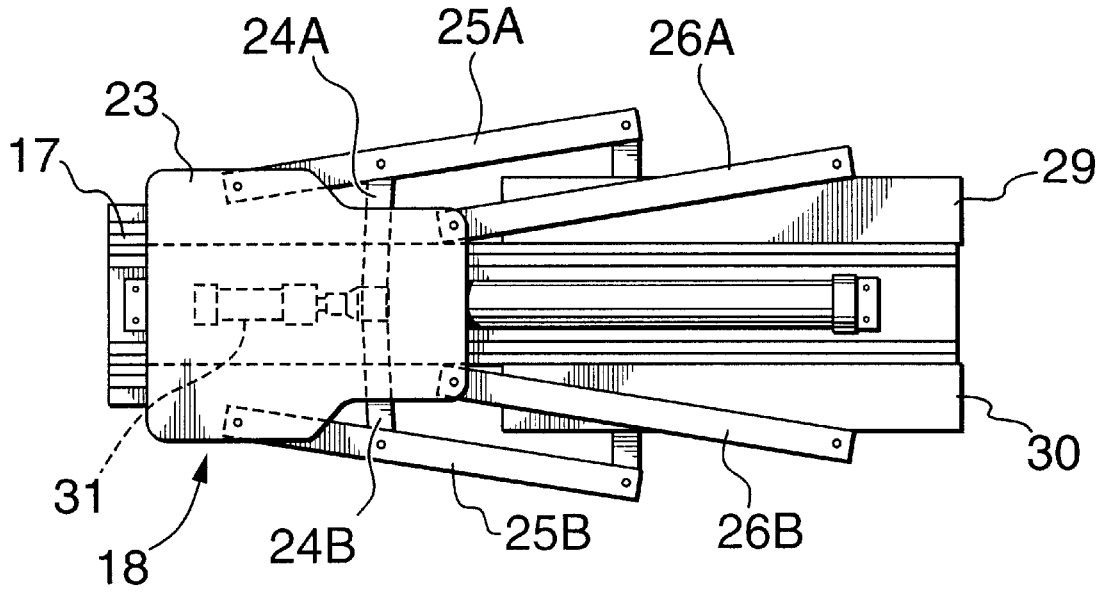
FIG. 2 is a bottom view of the sealer mechanism.
Figure 3:
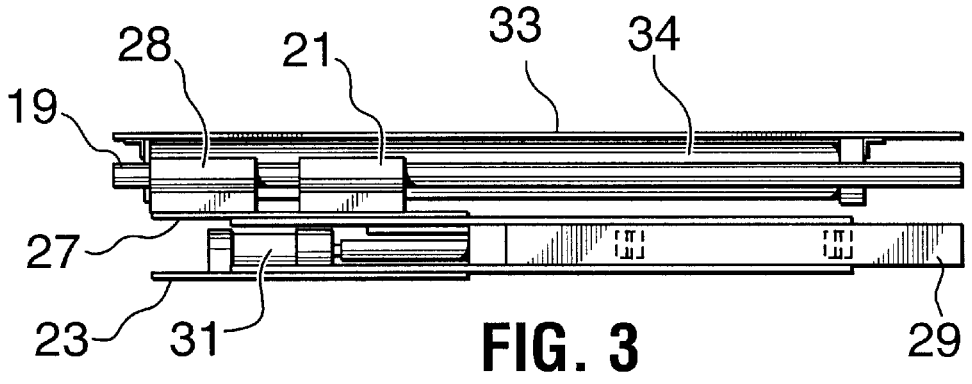
FIG. 3 is a side view of the sealer mechanism.
Figure 4:
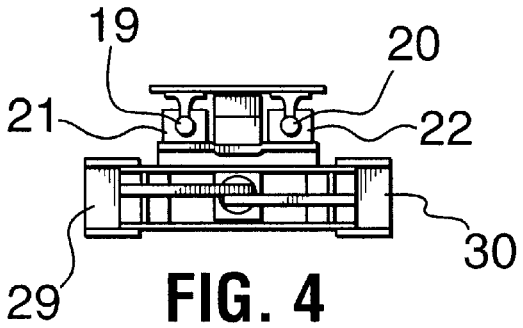
FIG. 4 is an end view of the sealer mechanism.
Figure 5:
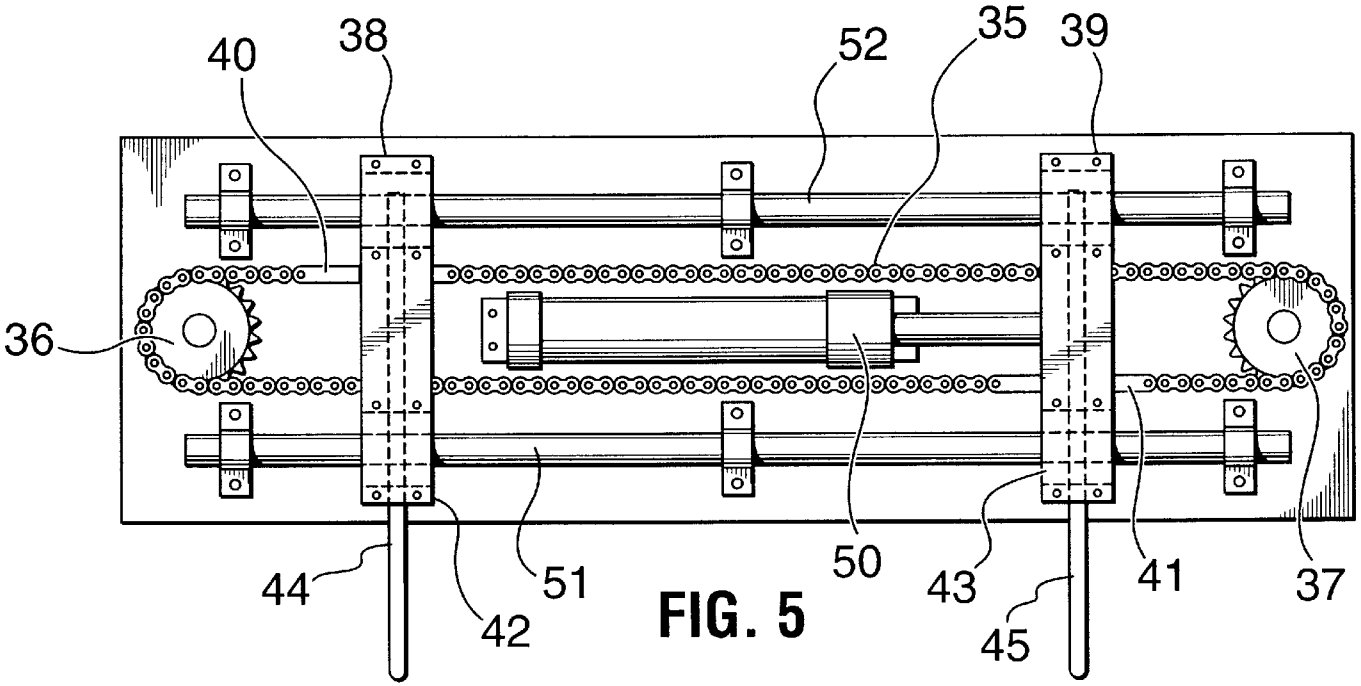
FIG. 5 is a top view of the finger mechanism.

FIGS. 3 through 5 describe sealing mechanism 12 in more detail. Sealing mechanism 12 includes a mounting arm (not shown), guide rail 17 and heat sealer assembly 18. Referring to FIG. 2, guide rail 17 allows heat sealer assembly 18 to move from a retracted position (shown) to an extended position (not shown). Referring to FIGS. 2, 3 and 4, guide rail 17 includes guide rods 19, 20 and band cylinder 34, all of which are secured to mounting plate 33. Referring to FIG. 2, heat sealer assembly 18 comprises bearings 21, 22, top plate 27, pneumatic cylinder 31, bottom plate 23, links 24*a*, 24*b*, 25*a*, 25*b*, 26*a*, 26*b* and heat sealers 29, 30. Band cylinder 34 propels heat sealer assembly 18 along guide rods 19, 20 which extend through bearings 21, 22. When heat sealer assembly is in the extended position, pneumatic cylinder 31 cooperates with links 24*a*, 24*b*, 25*a*, 25*b*, 26*a*, 26*b* to control heat sealers 29, 30. Additional guidance control is provided by two other bearings which are positioned behind bearings 21, 22 one of which is shown as 28 in FIG. 3.

Figure 6:
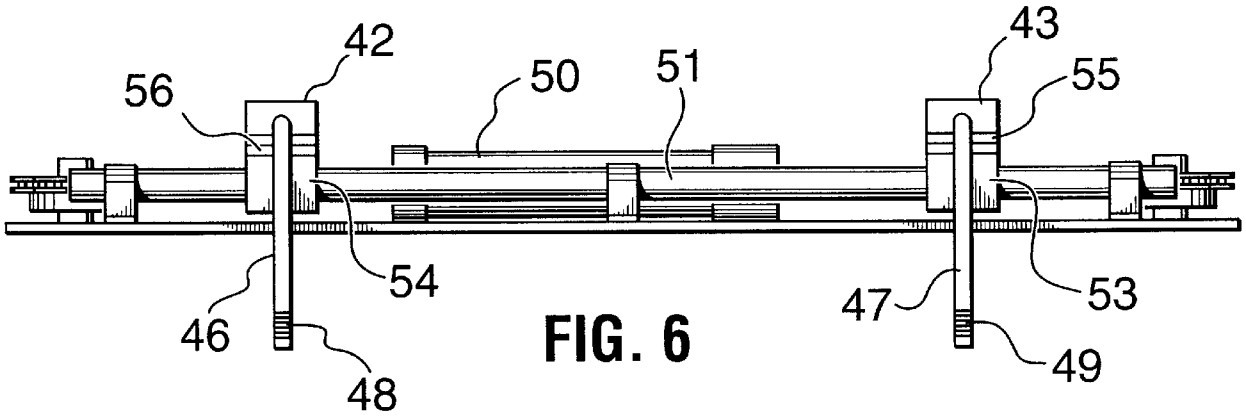
FIG. 6 is a side view of the finger mechanism.

Referring to FIGS. 5 and 6, finger mechanism 11 is depicted. Chain 35 extends between idler sprockets 36, 37. Finger assemblies 38, 39 are secured to chain 35 at link arms 40, 41 respectively. Finger assemblies 38, 39 includes clamps 42, 43, four bearing blocks (two of which are shown as 53, 54), connecting plates 55, 56, finger rods 44, 45, and fingers 46, 47 which terminate in air jets 48, 49. The connecting rod of pneumatic cylinder 50, is secured to connecting plate 55 by means of a device (not shown) and causes finger assemblies 38, 39 to move laterally apart or together when pneumatic cylinder 50 is extended or retracted. Guide rods 51, 52 extend horizontally through the four bearing blocks (guide rod 51 is shown extending through bearing blocks 53, 54 in FIG. 6) and assist in the lateral tracking of finger assemblies 38, 39.

In operation, carriage 5 is adjusted to the height of the bag being filled by movement of pneumatic cylinder 13, while forks 15, 16 are laterally adjusted to accommodate the bag width. As carriage 5 moves up and down support frame 6, finger mechanism 11, fork assembly 10, sealing mechanism 12 and lower portion 7B connected to inflatable sleeve 8 also move, while flexible sleeve 9 collapses or expands accordingly. Once the carriage is set, an operator places an empty thermoplastic bag over inflatable sleeve 8 and fingers 46, 47 which are positioned adjacent to and on opposite sides of inflatable sleeve 8. The operator also places loops extending from the bag over forks 15, 16. Since the weight of a filled bag can be as much as 1000 kilograms, support from forks 15, 16 is necessary. The inflatable sleeve inflates filling the bag opening, while fingers 46, 47 move laterally apart to accommodate the expanding sleeve. When a dust-tight seal has been achieved, product begins to move down spout 7. After the filling operation is complete, the sleeve deflates, lower portion 7B is retracted vertically upward and fingers 46, 47 begin to move laterally outward under the control of pneumatic cylinder 50, causing the end of the thermoplastic bag to be stretched to its limit and ready for sealing. Band cylinder 34 of sealing mechanism 15 then moves heat sealer assembly 18 forward, while pneumatic cylinder 31 causes heat sealers 29, 30 to close against the sides of the stretched end of the thermoplastic bag. When the sealing operations have been completed, sealing assembly 18 retracts and finger assemblies 38, 39 move laterally inward to their starting position, thereby relaxing the bag end. Air jets 48, 49 then blow the bag off fingers 46, 47 and the filled bag is then removed from the filling and sealing station. Lower portion 7B is then extended vertically downward to the filling position. The cycle described above is then be repeated.

It will be understood by those skilled in the art that the term "thermoplastic bag" is a generic one. A bag which may be used with the present invention may consist of a polywoven plastic with or without a liner or some other bag construction providing that either the bag or liner used are composed of heat sealable materials.

Figure 7:
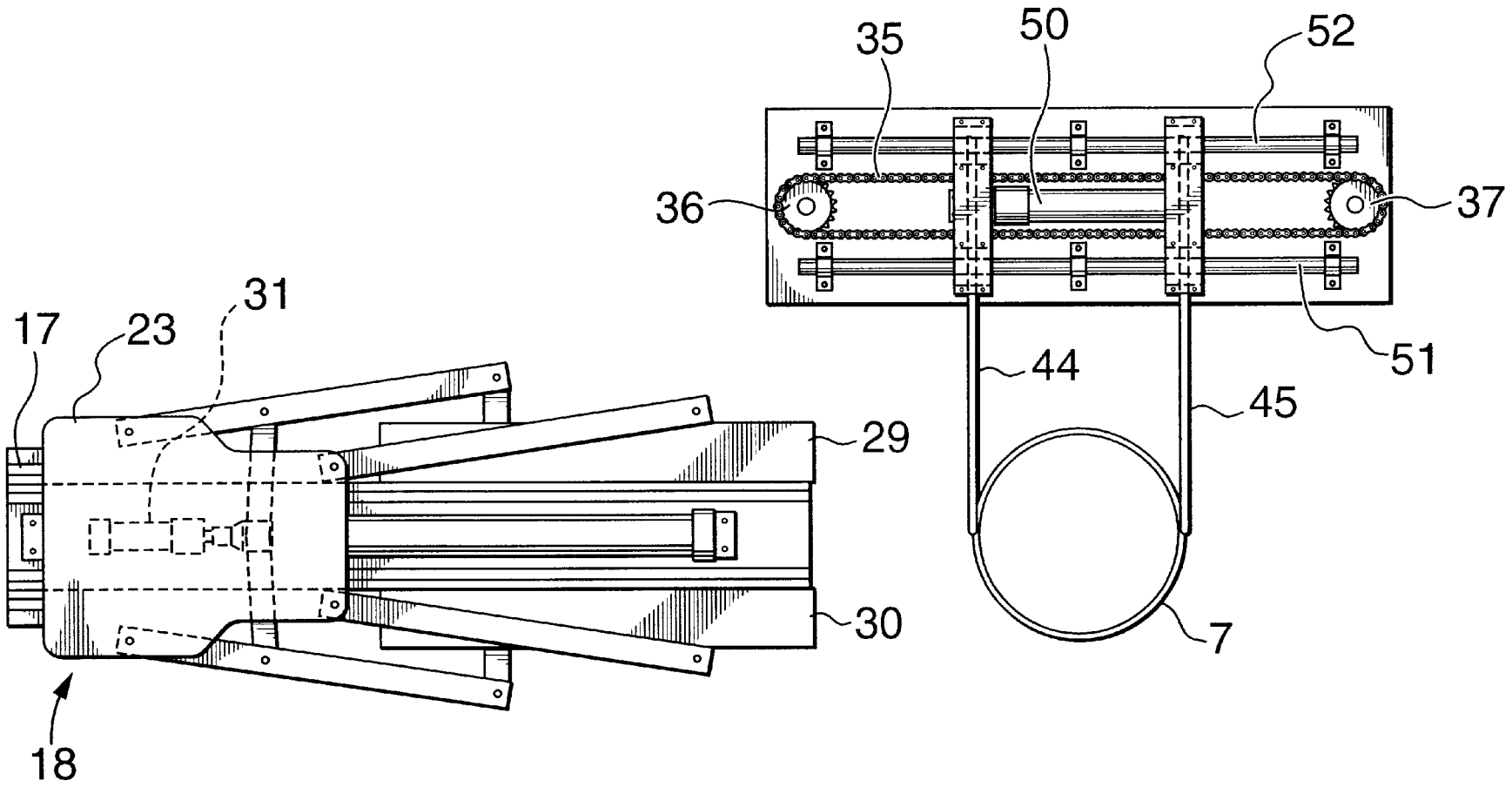
FIG. 7 is a partial top view of the finger mechanism and sealer mechanism with the sealer mechanism in the retracted position.
Figure 8:
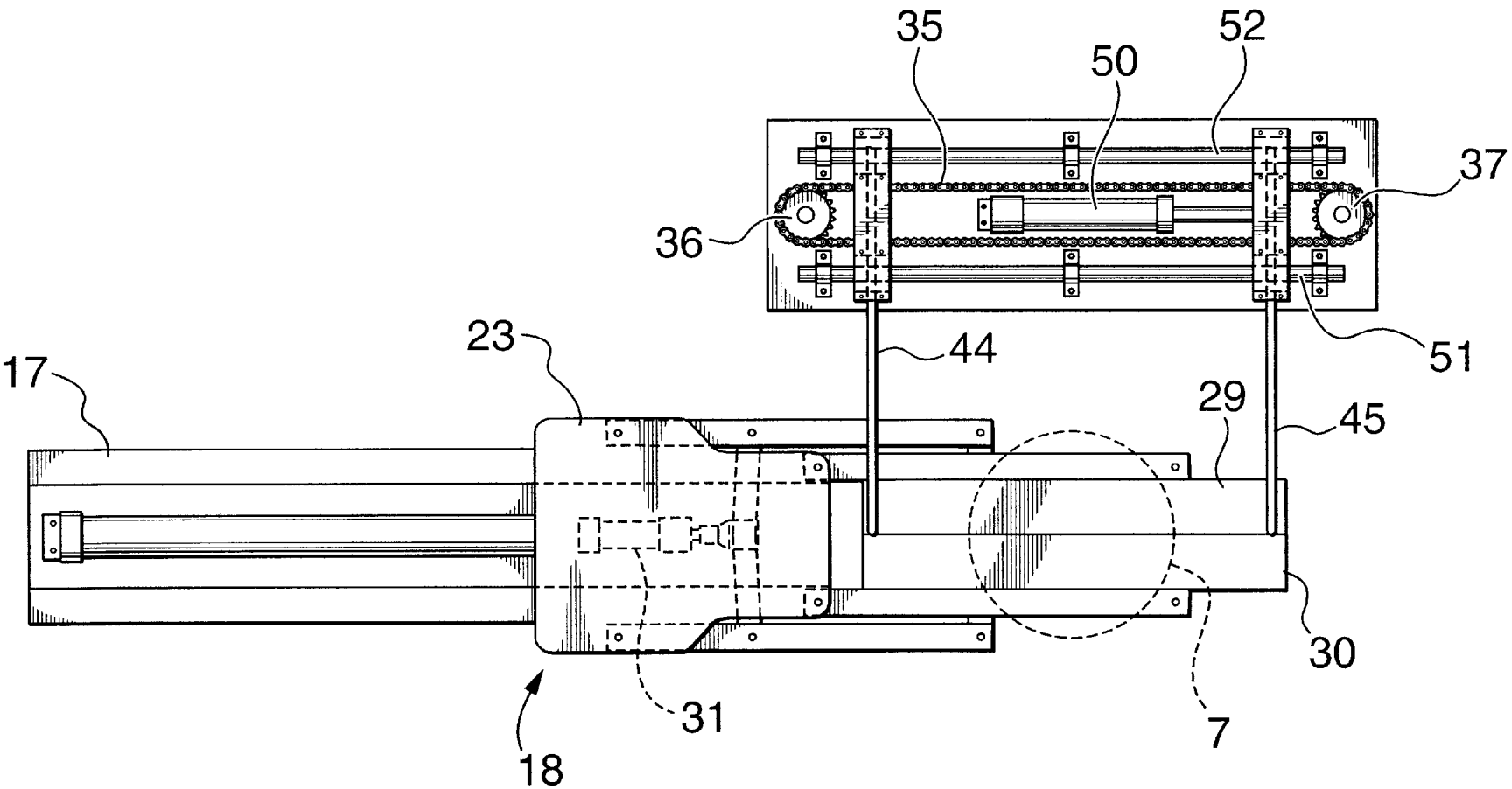
FIG. 8 is a partial top view of the finger mechanism and sealer mechanism with the sealer mechanism in the extended position.

FIGS. 7 and 8 are partial top views showing the finger mechanism 11 and sealing mechanism 12 of the present invention in operation. In FIG. 7, heat sealer assembly 18 is in the retracted position, while finger rods 44, 45 are adjacent inflatable sleeve 8, ready to receive a thermoplastic bag. In FIG. 8, finger rods 44, 45 have moved laterally apart to ready a stretched thermoplastic bag for sealing. Heat sealer assembly 18 is in the extended position with heat sealers 29, 30 pressed together to seal the stretched thermoplastic bag.

The embodiments of the invention in which an exclusive property or privileged is claimed are defined as follows:

1. An apparatus for filling and sealing thermoplastic bags at a single work station comprising:

a framework comprising a base portion for receiving a thermoplastic bag to be filled, closed and sealed, a support backplane which extends upwardly from the base portion and a pneumatically controlled carriage slidably received by said support backplane;

bag opening and filling means operatively secured to said framework and comprising a pneumatically controlled filling spout having an upper portion mounted to said support backplane, a lower portion connected by to said upper portion by a flexible sleeve and having an inflatable sleeve extending therefrom, thereby enabling said bag opening and filling means to be adjusted vertically with reference to said base portion;

bag supporting means comprising at least two forks extending perpendicularly from said carriage on opposite sides of said inflatable sleeve, wherein said forks are laterally adjustable;

bag aligning means comprising at least two fingers which extend perpendicularly from said carriage and which operatively cooperates with said bag opening and filling means, wherein said fingers are moveable from a first position to receive the open end of a bag, and to a second position to align the bag for sealing;

bag sealing means to seal the open end of said bag, said bag sealing means extending from said carriage in a horizontally planar and transverse relationship with the fingers of said bag aligning means and including a mounting arm, a guide rail, a heat sealer assembly is moved along said guide rail by said first pneumatic cylinder and includes opposing sets of interlocking and folding arms each of which terminate in a heat sealer, at least one of said interlocking arms from each set being rotationally connected to said heat sealer assembly to allow said sets of interlocking arms to be moved from a retracted position to an extended position by said second pneumatic cylinder.

2. The apparatus of claim 1, wherein the base portion includes a scale platform.

3. The apparatus of claim 2 wherein the base portion includes a vibrating platform.

* * * * *